United States Patent [19]

Michard et al.

[11] Patent Number: 4,773,980

[45] Date of Patent: Sep. 27, 1988

[54] PROCESS AND APPARATUS FOR SEALING CATHODIC BARS IN A PRESTRESSED CONDITION

[75] Inventors: Laurent Michard, Bourg-La-Reine; Gabriel Audras, Lyons, both of France

[73] Assignees: Aluminium Pechiney, Paris; Societe des Electrodes et Refractaires Savoie Sers, Courbevoie, both of France

[21] Appl. No.: 111,192

[22] Filed: Oct. 22, 1987

[30] Foreign Application Priority Data

Nov. 10, 1986 [FR] France ..... 86 15803

[51] Int. Cl.[4] ..... C25B 9/00

[52] U.S. Cl. ..... 204/250; 204/243 R

[58] Field of Search ..... 204/243 R, 243 M, 244–245, 204/250; 254/1, 134.3 R

[56] References Cited

U.S. PATENT DOCUMENTS 3,434,955 3/1969 Duclaux ..... 204/243 R 3,627,670 12/1971 Duclaux ..... 204/243 R

*Primary Examiner*—R. L. Andrews

*Attorney, Agent, or Firm*—Dennison, Meserole, Pollack & Scheiner

[57] ABSTRACT

The invention concerns a process and an apparatus for applying prestresses to carbonaceous cathodic blocks in the operation of sealing the cathodic bar in position with cast iron.

The block (1) in the course of the sealing operation is lifted on two rollers (16A, 16B) in the vicinity of its ends (E) and stresses F1 and F3 are simultaneously applied respectively to the ends (10) of the lateral edges of the limb portions (3) of the block and to the central part (C) of the block. Such stresses must be applied during the sealing operation and maintained for 15 to 30 minutes after the end of the cast iron casting operation.

That virtually totally suppresses the occurrence of cracks in the cathodic blocks.

13 Claims, 3 Drawing Sheets

FIG.1
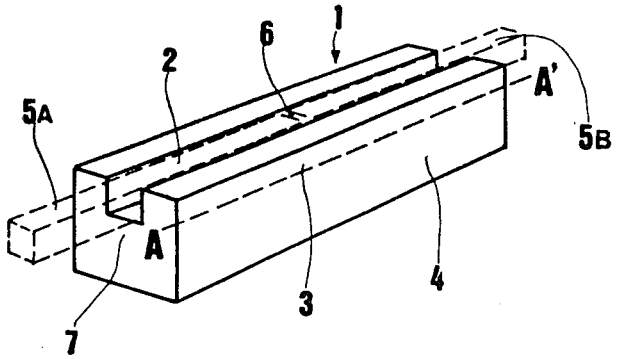
FIG.2
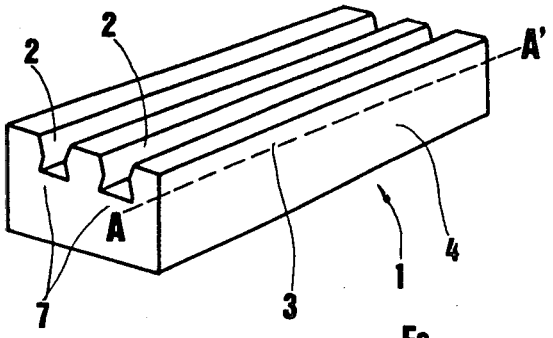
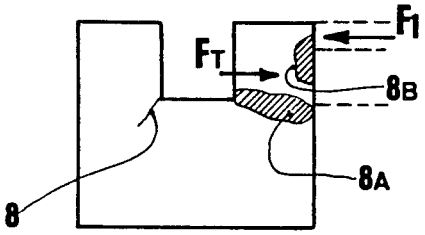
FIG.3
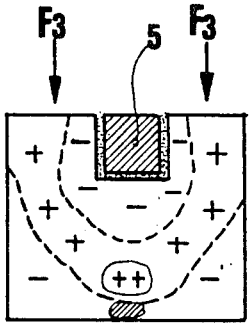
FIG.4A
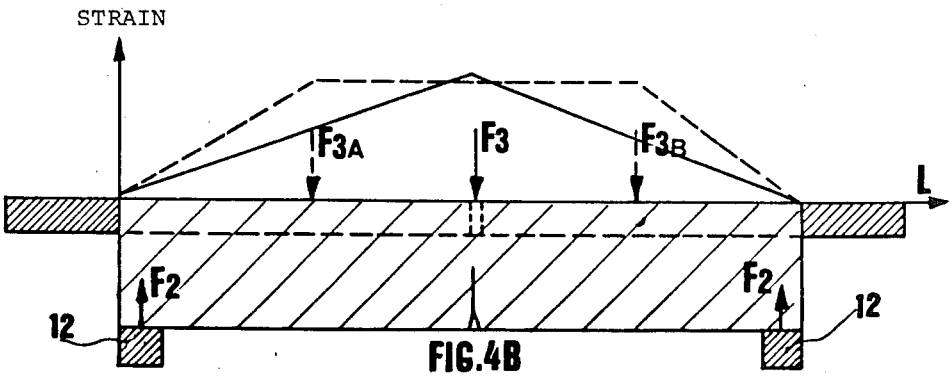
FIG.4B 27A
28
26
27B
5AB
29A
29B
1
16
26
f1
f1
5
F1
F1
1
16

B
C
31
30A
1
30B
16B
5B
21
17
5A
13
16A
14
B
22
18
19
20
23
15
C
14
25
24
D2
D1
33
36
37
38B
34
38A
39
F3
F3
31
32
35
1
14

D2
D1
34
32
37
35
F3
F3
1
P

PROCESS AND APPARATUS FOR SEALING CATHODIC BARS IN A PRESTRESSED CONDITION

TECHNICAL FIELD OF THE INVENTION

The present invention concerns a process and an apparatus for sealing cathodic bars in a prestressed condition in carbonaceous blocks which form the cathode in electrolysis tanks for the production of aluminium using the Hall-Heroult process.

STATE OF THE ART

In such tanks, the cathode is formed by an assembly of parallelepipedic carbonaceous blocks which are disposed in contiguous relationship and at the base of which has been cut one (or sometimes two) grooves in which an iron bar (or sometimes two half bar portions) are sealed by casting a special cast iron. The iron bar projects at the ends of the block so as to be extended to the outside of the tank, with the ends of the iron bar forming the "cathodic outputs" to which are connected the "cathodic collectors" which carry the electrolysis current to the anodic system of the following tank in the series. That arrangement is virtually universal and it is described for example in French Pat. No. 1 161 632 (PECHINEY) or U.S. Pat. No. 3,489,984 (BAILEY).

DISADVANTAGES OF THE PRIOR ART

The general trend is to increase the unit power and therefore the dimensions of electrolysis tanks and the intensity passing therethrough. For cathodic blocks of large dimensions, the thermal shock which is involved in the operation of casting the cast iron at the time of sealing the bar in the cathodic block gives rise to mechanical stresses which can be sufficiently severe to cause cracking of certain regions of the carbonaceous block and in particular at the ends of the grooves or, in the central part, on the outside edge of the limb portions of the block.

If a cracked block is used for making up a tank vessel, the crack tends to be enlarged in the tank in operation of the arrangement; that phenomenon can result in premature demise of the cathode due to the infiltration of liquid aluminum into the crack. It is for that reason that any cracked block has to be rejected, which can give rise to considerable increases in costs.

In French Pat. No. 2 175 658 or U.S. Pat. No. 3,851,377 in the name of Société des Electrodes et Refractaires "SAVOIE", it is proposed that a longitudinal compression stress should be applied to the casting operation in the parts of the block adjoining the external longitudinal edges of the limb portions, with such longitudinal compression stress substantially reducing the risk of sealing cracks appearing.

SUBJECT-MATTER OF THE INVENTION

The subject-matter of the invention is a process for sealing at least one metal cathodic bar in each groove of a parallelepipedic carbonaceous block intended to form the cathode of a tank for the production of aluminium by electrolysis, said process comprising casting liquid cast iron in the free space between each cathodic bar and each groove in the carbonaceous block, the block during the sealing operation being so positioned that the groove and the limb portions are directed upwardly, and put under prestress during the operation of casting the cast iron and for a period of time which is at least equal to ten minutes after the end of the casting operation, characterised by applying prestresses on the one hand to the two ends of the block, on the side edge of the two limb portions, and on the other hand, on the upper face of the limb portions of the block, at at least one point, either in the central portion or at two intermediate points, for example at one third and at two thirds of its length. It will be appreciated that the word "point" is not to be taken in its strict geometrical sense but denotes the zone in which the stress is applied and the extent of which corresponds to that of the apparatus for applying said stress (head of the jack or intermediate plate of sufficient surface area to avoid punching or marking of the cathodic block).

Further subject-matter of the same invention is an apparatus for carrying out the sealing process, characterised in that it comprises:

- a means for lifting the cathodic block by virtue of supports disposed in the vicinity of each end of the block,
- two identical means for applying lateral prestresses to the ends of the lateral edges of the two limb portions of the block, at each end of the block, and
- a means for applying vertical prestresses to the upper face of the part of the limb portions in the central part of the block.

The prestressing forces may be applied by any known means and more particularly by jacks (mechanical, hydraulic, pneumatic or electrical) or heavy weights.

DESCRIPTION OF THE DRAWINGS

FIGS. 1 to 10 illustrate the mode of carrying the invention into effect.

FIGS. 1 and 2 show two types of cathodic blocks having one and two bars, FIG. 3 indicates the regions in which the prestresses are concentrated in the sealing operation and when applying lateral prestresses, FIGS. 4A and 4B show the effects of applying vertical prestresses to the upper face of the block, either in its central part or at two points disposed at approximately one third and two thirds of its length, FIG. 5 shows the regions for the privileged occurrence of cracks, FIGS. 6 and 7 diagrammatically show the regions in which prestressing forces are applied, and FIGS. 8, 9, 9A and 10 show by way of example an apparatus for generating the prestressing forces.

Figure 5:
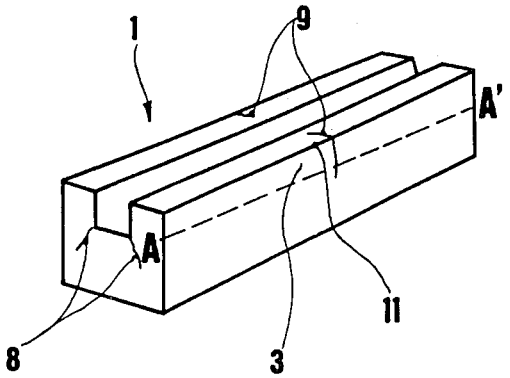
Figure 6:
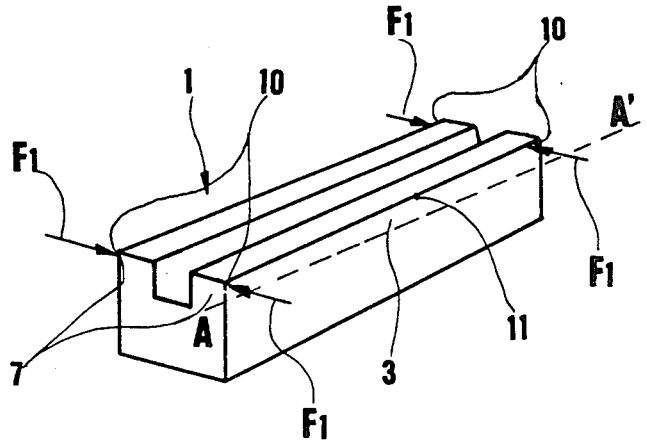
Figure 7:
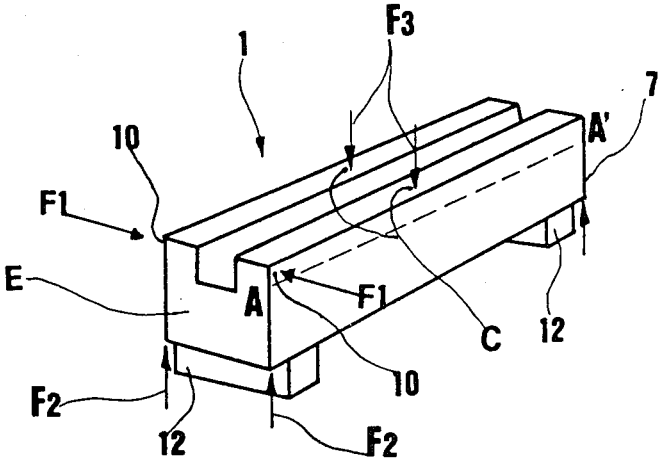

In the following specification, and including in the drawings, the cathodic blocks will be considered in the position that they occupy in sealing operations, that is to say with the groove or grooves for sealing cathodic bars in position directed upwardly, being therefore in an inverted position in relation to the position that they will occupy when mounting the cathode in each electrolysis tank where the assembly of the cathodic bars is disposed under the carbonaceous blocks.

FIGS. 1 and 2 show two types of cathodic blocks 1 with respectively one and two sealing grooves 2. The term "limb portion" of the cathodic block is generally used to denote the upper part 3 which is disposed on the two large sides 4 of the parallelepiped which is formed by the block, above the level of the sealing groove 2, approximately above the broken line AA'.

FIG. 1 also shows in broken lines the contour of two cathodic half bar portions 5A and 5B which leave a central space of a few centimeters between them, as indicated at 6.

For sealing the bars (or half bar portions), closure plugs of rock wool or the like are provided at the two ends and in the space 6, and the liquid cast iron coming directly from a smelting furnace is poured, optionally after preheating of the bars and the block to a temperature which may attain for example 700° C.

After cooling the blocks are turned over through 180° so that, at the time at which they are set in position in each tank to form the cathode, the metal bars are disposed beneath the blocks.

The main cracks are formed at the end 7 of the groove, these being the cracks 8 which are referred to as "V"-shaped cracks, while on the outside edge of the limb portions 3, generally in the central part, there are cracks which are referred to as "transverse" cracks, as indicated at 9.

To avoid the formation of cracks which appear shortly after the commencement of cooling of the cast iron (generally in the quarter of an hour which follows the end of the casting operation), prestresses of appropriate direction and sufficient intensity are simultaneously applied to the regions in which cracks occur.

Such prestressing forces may be applied either by means of a jack (of all types) or by means of heavy weights, or by a combination of the two methods.

On looking at FIG. 3, it will be seen that the limb portions of the block are subjected to antagonistic forces in the course of that operation. On the one hand, it is known that the stresses $F_T$ due to the thermal effects in the course of the sealing operation tend to induce V-shaped cracks 8 by a shearing effect (traction) in the hatched region 8A. However the prestress F1 applied to the upper part of the limb portion tends above a certain level to cause rupture of the limb portion in a tensile mode in the hatched area 8B.

It is therefore necessary for the prestress F1 to be very precisely adjusted in dependence on the mechanical characteristics of the carbon forming the block, in such a way that it balances the sealing stress which tends to cause the cracks 8, while remaining at a lower level than the breaking stress of the material in tension in the zone 8B.

In practice, and with carbonaceous blocks of conventional dimensions which are used in 150 to 200 KA electrolysis tanks, forces F1 which may attain 100 to 200 daN are applied in the vicinity of the lateral ends of the limb portions 3, at the points 10, by means of jacks. By way of non-limiting example, the blocks may be 500 mm in width, 450 mm in height and 2400 mm in length, with a groove which is 160 mm in width and 155 mm in height. The point 10 of application of the force is preferably disposed in the upper third of the height of the limb portion.

The prestressing operation is effected prior to casting the cast iron and the prestressing is maintained for at least 10 minutes after the end of the casting operation and in practice for 10 to 30 minutes.

In order to prevent the formation of transverse cracks 9 on the outside edges 11 of the limb portions 3, it is possible to apply a vertical upwardly directed force F2 under the two ends of the blocks 1 simultaneously with a downwardly directed vertical thrust force F3 on the central part of the block 1. However it is also possible and easier to place the two ends E of the blocks 1 on two rigid supports 12 which are disposed beneath the ends thereof and to apply solely the prestressing force F3 to the upper face of the block, either at a point located in the central part thereof or at a plurality of points, for example at two points which are disposed approximately at one third and at two thirds of the length thereof. The force F2 is then formed by the reaction of the rigid supports 12.

The application of that prestressing force in opposition to transverse cracking gives rise to the same problem as in respect of the V-shaped cracks. FIG. 4A shows that, if the prestressing force F3 is applied to the two upper faces on respective sides of the central groove, it is found that the block is subjected to a plurality of mechanical stressing forces (prestressing force F3 plus thermal stresses due to the sealing operation) in compression (regions marked by the sign −) and in tension (regions marked by the sign +), with a maximum (indicated by the two signs +) in the bottom part which is beneath the sealing groove. Such stresses could also result in rupture of the block if they were to exceed the tensile breaking strength of the carbonaceous material, which is between 2 and 5 MPa (about 20 to 50 kg/cm$^2$).

FIG. 4B also shows the level of prestressing in the block depending on whether F3 is applied in the central part (the solid-line curve, referred to as the "triangle" curve) or at two points F3A, F3B, at approximately one third and two thirds of the length L (broken-line curve, referred to as the "trapezium" curve). In the second case, the prestressing is more homogenously distributed and the risk of rupturing the block when it is put under prestress is reduced, provided that, as in the case of the V-shaped cracks, the prestressing F3 is so calculated as to compensate for the sealing stresses without exceeding the tensile breaking stress of the block.

Figures 8, 9, 9A, 10:
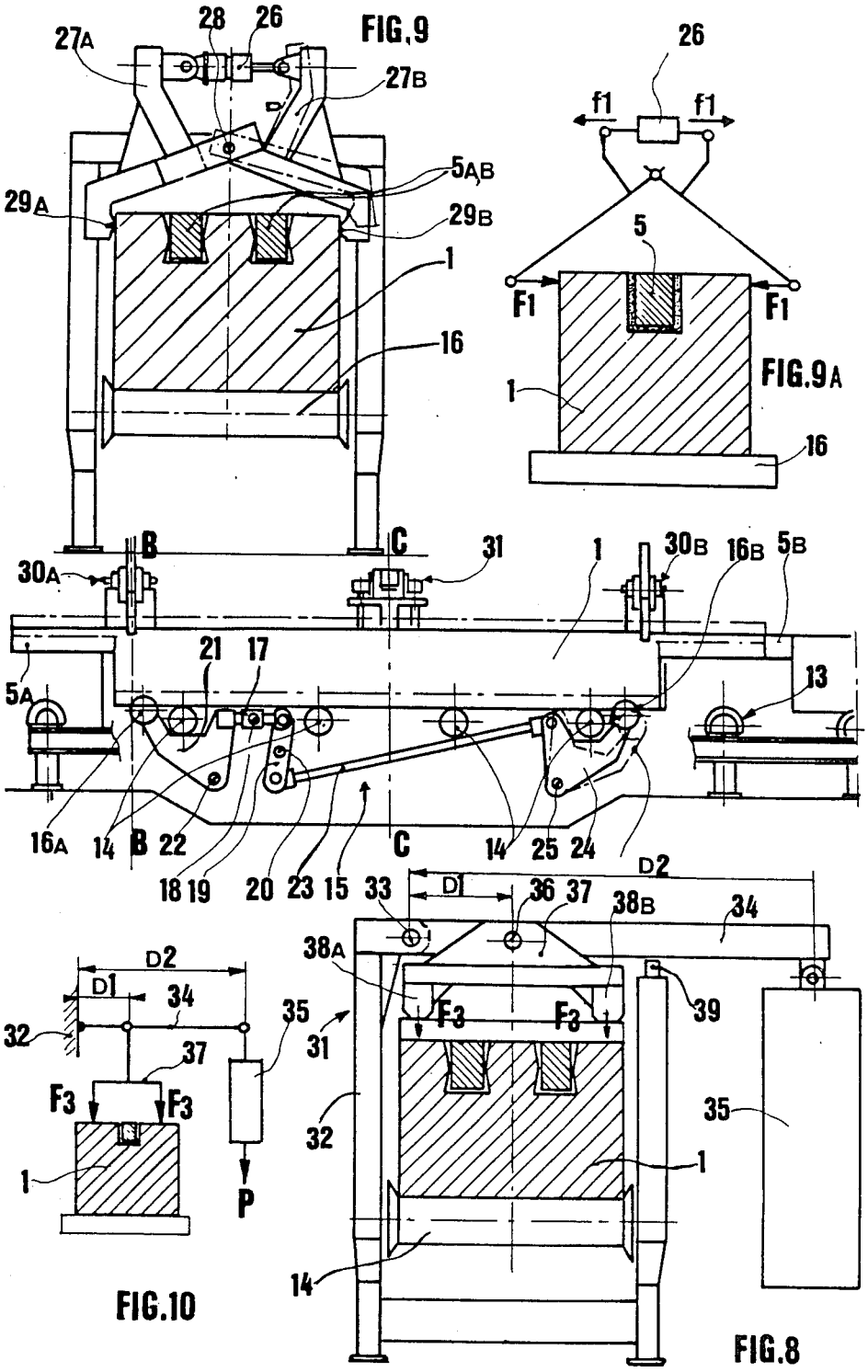

FIG. 8 is a view in central longitudinal section of the apparatus for carrying out the invention.

The block 1 is delivered by the roller conveyor 13 to the sealing station where it is first supported on the four rollers 14. After the cathodic bars 5A and 5B have been set in position, the block is raised by a few millimeters by means of the pivoted assembly 15 which is provided at its ends with two support rollers 16A and 16B.

The assembly 15 is formed by a jack 17 which is mounted on a fixed point 18 and which applies on the one hand a thrust force to the arm 19 which is pivotally mounted in its central portion at 20, and on the other hand, a pulling force to the triangular arm 21 which is pivotally mounted on the fixed point 22. As a result of that action, the roller 16A is lifted by a few millimetres and, by way of the rod 23 and the second triangular arm 24 which is pivotally mounted on the fixed point 25, the second roller 16B is raised by a height substantially equal to that of the first roller. The block 1 is therefore then only supported on the two rollers 16A and 16B. The whole of the lifting mechanism is integrated with the roller conveyor which delivers the block 1 to the sealing station.

The following forces are then applied to the block 1 (given by way of non-limiting example, and in the case of a block measuring 450×500×2400, as already referred to above):

- 4 substantially equal forces F1, applied at the ends of the limb portions 3 (see FIG. 4), at the points 10; and
- 2 substantially equal forces F3 which are applied to the upper central part (C) of each outer limb portion 3 or, in an alternative form, 4 substantially equal forces F3A, F3B, at one third and two thirds of the length of the block.

The 4 forces F1 are applied by means of the apparatus diagrammatically shown in FIG. 9A. A jack 26 simultaneously applies to two rigid arms 27A and 27B which are pivotally mounted at point 28, a thrust force which has the effect of applying two substantially equal stresses F1 symmetrically by way of the bearing members 29A and 29B.

One of those apparatuses is mounted at one end of the block 1. A second apparatus 30A identical to 30B is positioned at the other end of the block 1. Each of the stresses 1 is of the order of 100 to 200 daN. Having regard to the nature of the material forming the block, it will be apparent that the forces must be applied by way of bearing plates having a sufficient surface area to avoid any risk of "punching" the carbon. That comment also applies to the vertical prestressing force F3. The central part of the block 1 is subjected to the action of the system 31 for producing a stressing force by means of a heavy weight.

The apparatus 31 is formed by a fixed gantry 32 on which a substantially horizontal arm 34 is pivotally mounted at 33. At its end which is in opposite relationship to the horizontal-axis pivotal mounting 33, the arm 34 supports a heavy weight 35 at a distance D1 from the pivot mounting 33. On an intermediate horizontal-axis pivot mounting 36, disposed at a distance D2 (<D1), the arm also supports a stirrup 37 for applying the vertical stress F3 in substantially symmetrical fashion to the upper face of the two limb portions. At each of its two ends the stirrup 37 carries two bearing blocks 38A and 38B which, when the block is lifted and the support 39 is retracted, apply the two stresses F3 which are equal to the weight of the mass 35 multiplied by the ratio of the lever arm D2/D1. If for example the pivot mounting 36 is disposed a quarter of the way along the length of the arm from the fixed point 33, a weight 31 of 1 tonne will apply a force of 4 tonnes, that is to say about 4000 daN, to the limb portions. In practice that prestressing force F3 may be between 1500 and 2500 daN (that is to say, 3000 to 5000 daN in total), and preferably around 2000 daN for the type of carbonaceous block indicated above (measuring 500×450×2400 mm).

In an alternative form, the forces F3 may be applied by means of a jack which for example may be connected to a stirrup which is identical or similar to the stirrup 37. In addition, as indicated above, they may also be applied at two points, disposed at approximately one third and two thirds of the length of the block, by means of two identical apparatuses 31.

After the prestressing forces F1 and F3 have been applied, it is possible to proceed with the cast iron casting operation under the usual conditions, while maintaining the application of F1 and F3 for a period which is at least equal to 15 minutes and which is preferably between 20 and 30 minutes after the end of the casting operation.

If necessary, cooling of the block may be slowed down by applying panels or blankets of heat-insulating material.

Use of the invention made it possible virtually completely to eliminate the occurrence of the sealing cracks.

In the recent construction of a series requiring the sealing and the positioning of more than 5000 cathodic blocks, 10 cracked blocks were found, that is to say 0.2%, whereas previously the average rate of cracking in the most serious cases could reach 5%.

We claim:

1. A process for sealing at least one metal cathodic bar into each groove in a parallelepipedic carbonaceous block intended to form the cathode of a tank for the production of aluminium by electrolysis, the process comprising casting liquid cast iron in the free space between each cathodic bar and each groove in the carbonaceous block, the block being positioned during the sealing operation in such a way that the groove and the limb portions are directed upwardly, and put under prestress during the operation of casting the cast iron and for a period which is at least equal to ten minutes after the end of the casting operation characterised by applying the prestresses on the one hand in the vicinity of the two ends of the block, on the lateral edge of the two limb portions (F1), and on the other hand at at least one point on the upper face of the limb portions of the block (F3).

2. A sealing process according to claim 1 characterised in that the prestresses are applied by a means of a jack.

3. A sealing process according to claim 1 characterised in that each prestress F1 is of a value of between 100 and 200 daN.

4. A sealing process according to claim 1 characterised in that each prestress F3 is of a value of between 1500 and 2500 daN.

5. A sealing process according to claim 1 characterised in that, at each end of the block, the prestresses F1 are applied by means of a single jack acting on two pivoted rods which act substantially symmetrically on the lateral edge of each limb portion.

6. A sealing process according to claim 1 characterised in that the prestress F3 is produced by a heavy weight disposed at the end of a lever arm and is applied substantially symmetrically to the upper face of the two limb portions.

7. A sealing process according to claim 6 characterised in that the prestress F3 is applied in the central part of the block.

8. A sealing process according to claim 6 characterised in that the prestress F3 is applied substantially at one third and two thirds of the length of the block.

9. Apparatus for carrying out the sealing process according to claim 1 characterised in that it comprises:

means (15) for lifting the cathodic block including support means disposed in the vicinity of each end of the block, two identical means (30A, 30B) for applying lateral stresses (F1) to the ends of the lateral edges of the two limb portions (3) of the block, at each end of the block, and means (31) for applying vertical stresses (F3) to the upper face of the part of the limb portions in the central part of the block.

10. Apparatus according to claim 9 characterised in that the means (15) for lifting the cathodic block comprises two rollers (16A, 16B) which are spaced by a distance slightly less than the length of the block, each roller being connected to a triangular arm (21, 24) pivotally mounted at a fixed point (22, 25), rotary movement of each arm about said fixed point being controlled by a double-acting jack (17).

11. Apparatus according to claim 9 characterised in that the means for applying the lateral stresses (F1) is formed by a jack (26) conected to one of the ends of two rigid arms (27A, 27B) pivotally mounted on a common fixed point (28), the other end (29A, 29B) thereof bearing against the outside edges of the limb portions of the block.

12. Apparatus according to claim 9 characterised in that the means for applying the vertical stresses (F3) to the upper face of the block comprises a weight (35) suspended at the end of a substantially horizontal arm (34), the other end of which is pivotally mounted on a fixed point (33), and which at an intermediate point (36) supports a stirrup (37) provided in its lower part with two bearing blocks (38A,38B).

13. A sealing process according to claim 1 characterised in that the prestresses are applied by a means such as a heavy weight

* * * * *